US008468668B2

(12) United States Patent
Ko

(10) Patent No.: US 8,468,668 B2
(45) Date of Patent: Jun. 25, 2013

(54) POSITIONING ASSEMBLY OF A HAND RIVET NUT TOOL

(75) Inventor: Philey Ko, New Taipei (TW)

(73) Assignee: Karat Industrial Corporation, New Taipei (TW)

( * ) Notice: Subject to any disclaimer, the term of this patent is extended or adjusted under 35 U.S.C. 154(b) by 6 days.

(21) Appl. No.: 13/414,982

(22) Filed: Mar. 8, 2012

(65) Prior Publication Data

US 2013/0061439 A1 Mar. 14, 2013

(30) Foreign Application Priority Data

Sep. 9, 2011 (TW) ..... 100132549 A

(51) Int. Cl.
*B21J 15/38* (2006.01)

(52) U.S. Cl.
USPC ..... 29/243.521; 29/243.528; 72/114; 72/391.8

(58) Field of Classification Search
USPC ..... 72/114, 391.8; 29/243.521, 243.526, 29/243.528
See application file for complete search history.

(56) References Cited

U.S. PATENT DOCUMENTS 4,140,000 A * 2/1979 Ehmann ..... 72/114
4,425,782 A * 1/1984 Todisco ..... 72/391.8
5,729,880 A 3/1998 Ko

* cited by examiner

*Primary Examiner* — David B Jones
(74) *Attorney, Agent, or Firm* — patenttm.us

(57) ABSTRACT

A positioning assembly of a hand rivet nut tool has a rotating sleeve, a mandrel and a positioning ring. The rotating sleeve has a mounting groove formed around an inner surface of the rotating sleeve. The mandrel is mounted through the rotating sleeve and has a positioning groove formed around an outer surface of the mandrel. The positioning ring is mounted in and around the mounting groove of the rotating sleeve and the positioning groove of the mandrel. The mandrel is stably held by the positioning ring in a specific position, so the hand rivet nut tool is able to stably rivet a rivet nut on a work piece. The hand rivet nut tool with the positioning assembly has simplified and optimized positioning effect, and reduced assembling time and cost.

2 Claims, 7 Drawing Sheets

POSITIONING ASSEMBLY OF A HAND RIVET NUT TOOL

BACKGROUND OF THE INVENTION

1. Field of the Invention

The present invention relates to a positioning assembly, especially to a positioning assembly of a hand rivet nut tool.

2. Description of the Prior Art(s)

A hand rivet nut tool is used for setting a rivet nut or a threaded insert with an internal thread portion having around six threads or more on a work piece, especially a thin work piece, to form a threaded hole on the work piece. The rivet nut is tubular or hexagonal, is mounted through a through hole of the work piece, such as a metal plate, tube or the like, and has a proximal end, a flange and the internal thread portion. The proximal end of the rivet nut is thin-walled. The flange of the rivet nut is for abutting a nosepiece of the hand rivet nut tool. The internal thread portion is disposed adjacent to a distal end of the rivet nut. The hand rivet nut tool has a mandrel having an external thread portion. When the mandrel is axially mounted in the rivet nut with the external thread portion of the mandrel engaging the internal thread portion of the rivet nut and is pulled, the flange of the rivet nut resists pressure that is from the nosepiece of the hand rivet nut tool that is exerted on the rivet nut by pulling the mandrel, the thin-walled proximal end of the rivet nut deforms, the rivet nut is riveted on the work piece, and the internal thread portion of the rivet nut is built up on the work piece. Thus, another work piece is able to be fastened to the work piece having an installed rivet nut with a bolt or a screw.

With reference to FIGS. 5 and 6, a conventional adjustable type hand rivet nut tool with quick-change mandrel, as disclosed in U.S. Pat. No. 5,729,880, has a tool body 50, an operating handle 52, a torsion spring 501, a nosepiece 53, a holding sleeve 54, a rotating sleeve 55 and a fastening nut 56. The tool body 50 has a top portion 502. The operating handle 52 is pivotally connected to the tool body 50 via a pivot pin 51. The torsion spring 501 is mounted between the tool body 50 and the operating handle 52, and has two arms respectively abutting the tool body 50 and the operating handle 52. The nosepiece 53 is attached to a front of the top portion 502 of the tool body 50. The holding sleeve 54 is slidably mounted in the top portion 502 of the tool body 50, is pivotally connected to an upper end of the operating handle 52 and has an internal thread. The rotating sleeve 55 is mounted through a rear of the top portion 502 of the tool body 50, is screwed to the holding sleeve 54 and has a through hole 551 axially formed through the rotating sleeve 55, and a rotating knob 552 formed around a rear end of the rotating sleeve 55. The fastening nut 56 is mounted around the rotating sleeve 55 and abuts the rear of the top portion 502 of the tool body 50.

A mandrel 60 is mounted through the through hole 551 of the rotating sleeve 55 and has a front end protruding out from the nosepiece 53, an external thread 61 formed around the front end of the mandrel 60, a mandrel knob 62 formed on a rear end of the mandrel 60. A rivet nut is screwed on the external thread 61 of the mandrel 60, and a flange of the rivet nut abuts the nosepiece 53. When the operating handle 52 is pushed, the operating handle 52 drives the holding sleeve 54 and the rotating sleeve 55 to move toward the rear of the top portion 502 of the tool body 50. Consequently, the rotating knob 552 of the rotating sleeve 55 pushes the mandrel knob 62 of the mandrel 60 and the mandrel 60 moves toward the rear of the top portion 502 of the tool body 50 to pull a thin-walled proximal end of the rivet nut. Thus, the thin-walled proximal end of the rivet nut deforms and is set on a work piece.

However, if the mandrel knob 62 of the mandrel 60 does not abut the rotating knob 552 of the rotating sleeve 55, the rotating sleeve 55 is unable to drive the mandrel 60 to deform the rivet nut and set the rivet nut on the work piece. Therefore, the mandrel 60 has to be stably positioned in the rotating sleeve 55 without any unwanted sliding and the mandrel knob 62 must abut the rotating knob 552. Then the conventional adjustable type hand rivet nut tool is able to set the rivet nut on the work piece.

With further reference to FIGS. 6 and 7, to avoid the above-mentioned problem, the rotating knob 552 of the rotating sleeve 55 has a threaded hole 70 being tapered and formed radially almost through the rotating knob 552. A steel ball 71 and a helical spring 72 are put in the threaded hole 70, and a bolt 73 is screwed in the threaded hole 70. The mandrel 60 further has a positioning groove 63 formed around an outer surface of the mandrel 60 and disposed adjacent to the mandrel knob 62. When the mandrel 60 is mounted into the through hole 551 of the rotating sleeve 55, the helical spring 72 pushes the steel ball 71, so the steel ball 71 abuts and rolls on the outer surface of the mandrel 60. When the steel ball 71 engages the positioning groove 63 of the mandrel 60, the mandrel knob 62 of the mandrel 60 abuts the rotating knob 552 of the rotating sleeve 55 and the mandrel 60 is stably mounted in the rotating sleeve 55.

However, drilling the rotating knob 552 of the rotating sleeve 55 to form the threaded hole 70, putting the steel ball 71 and the helical spring 72 in the threaded hole 70 and screwing the bolt 73 in the threaded hole 70 are complicated processes and take high assembling cost and much assembling time.

Moreover, drilling the rotating knob 552 to form the tapered threaded hole 70 is difficult and needs precise work, or the steel ball 71 would drop out of the threaded hole 70 when the mandrel 60 is drawn out of the rotating sleeve 55.

Furthermore, after drilling the rotating knob 552, multiple burrs are also formed on an outer surface of the rotating knob 552. The burrs have to be removed or the burrs would injure users.

With reference to FIG. 7, since the steel ball 71 and the mandrel 60 are only having point-contact, the mandrel 60 is still likely to slide relative to the rotating sleeve 55 and the point-contact results in poor positioning effect.

To overcome the shortcomings, the present invention provides a positioning assembly of a hand rivet nut tool to mitigate or obviate the aforementioned problems.

SUMMARY OF THE INVENTION

The main objective of the present invention is to provide a secure positioning assembly of a hand rivet nut tool. The positioning assembly has a rotating sleeve, a mandrel and a positioning ring. The rotating sleeve is tubular and has a mounting groove formed around an inner surface of the rotating sleeve. The mandrel has a positioning groove formed around an outer surface of the mandrel. The positioning ring is mounted in and around the mounting groove of the rotating sleeve.

When the mandrel is axially mounted through the rotating sleeve, the positioning ring is further mounted in the positioning groove of the mandrel, so the mandrel is stably held by the positioning ring in a specific position to allow the hand rivet nut tool to stably rivet a rivet nut on a work piece. The hand rivet nut tool with the positioning assembly has simplified and optimized positioning effect, and reduced assembling time and cost.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
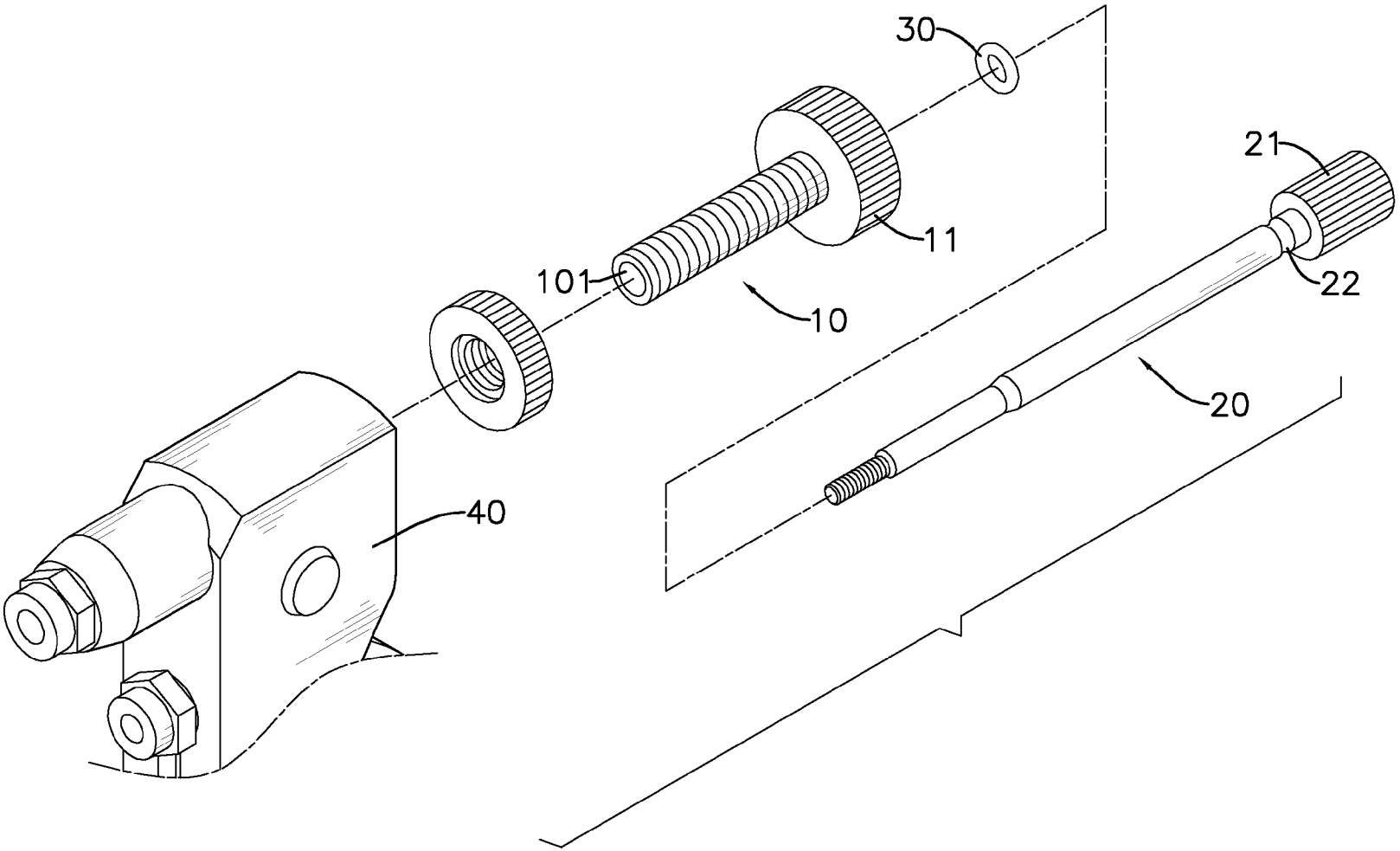
FIG. 1 is an enlarged operational exploded perspective view of a positioning assembly of a hand rivet nut tool in accordance with the present invention.

With reference to FIG. 1, a positioning assembly of a hand rivet nut tool in accordance with the present invention comprises a rotating sleeve 10, a mandrel 20 and a positioning ring 30.

Figure 2:
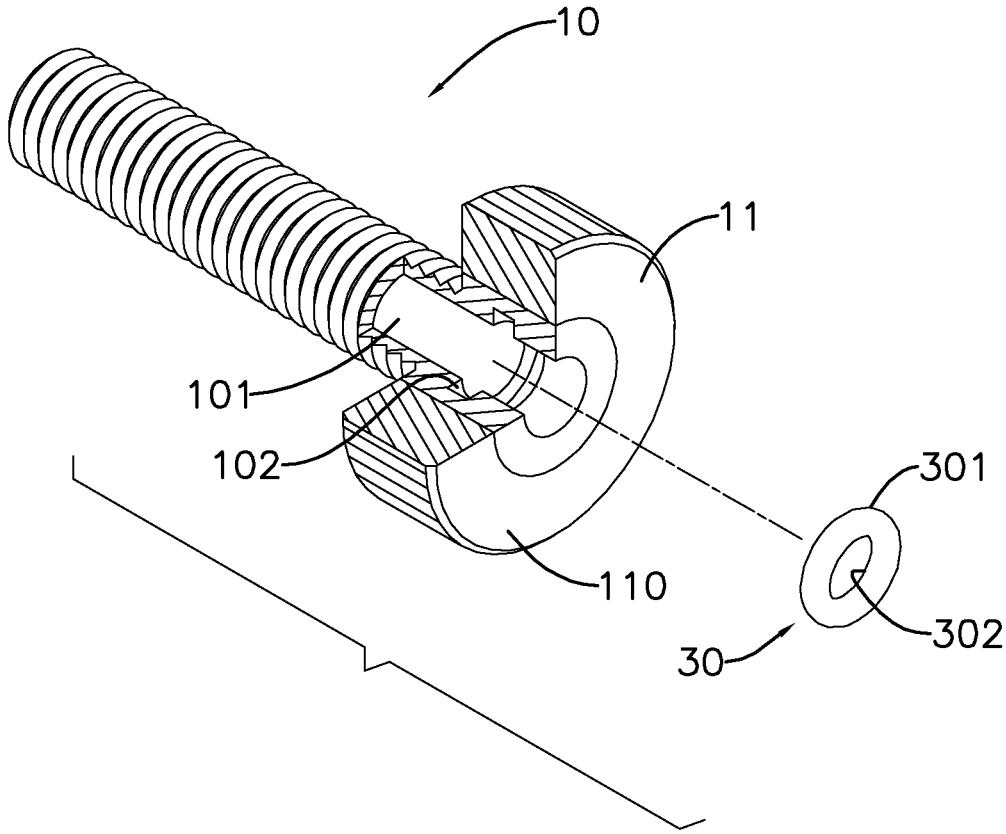
FIG. 2 is a perspective view in partial section of the positioning assembly of the hand rivet nut tool in FIG. 1.
Figure 3:
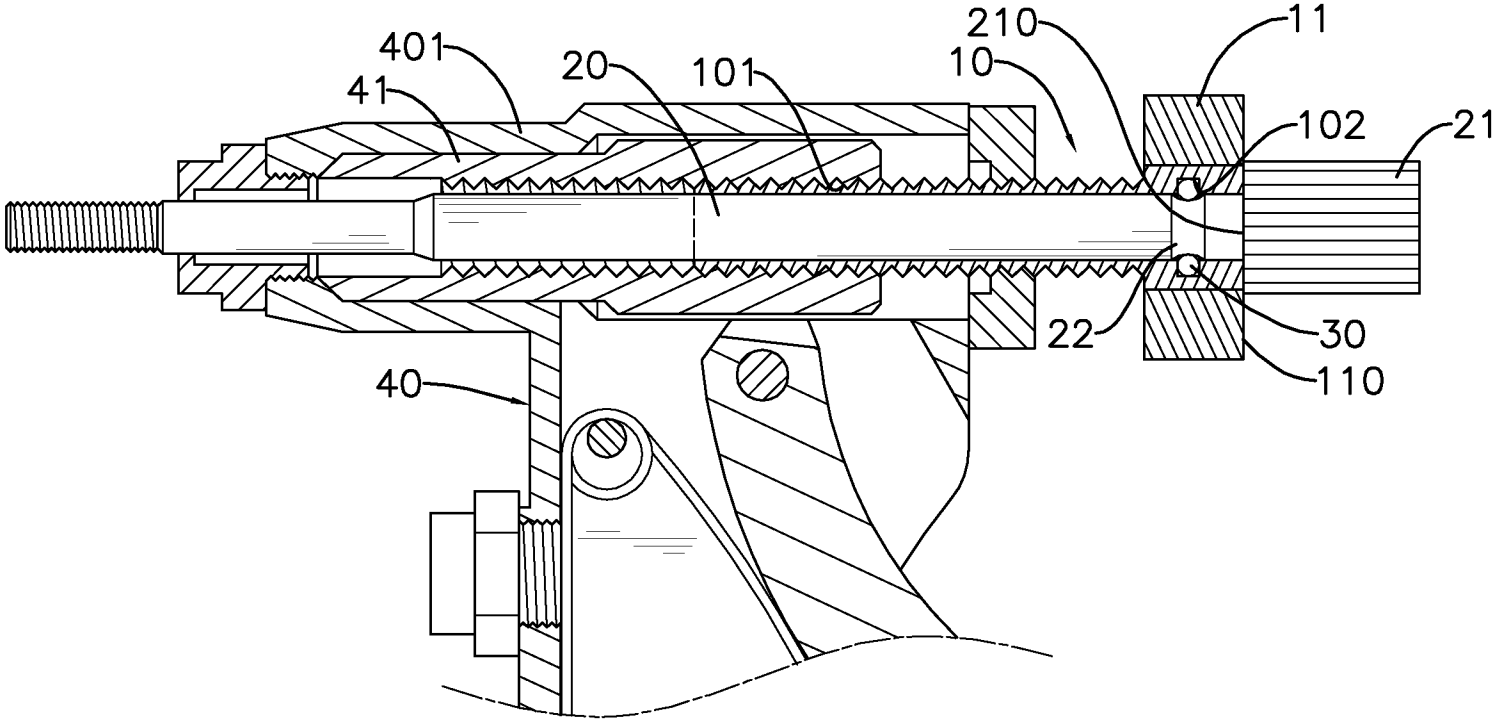
FIG. 3 is an enlarged operational side view in partial section of the positioning assembly of the hand rivet nut tool in FIG. 1.

With further reference to FIGS. 2 and 3, the rotating sleeve 10 is tubular and has an outer end, an outer surface, a through hole 101, an inner surface, a rotating knob 11, a mounting groove 102 and an external thread. The through hole 101 of the rotating sleeve 10 is axially formed through the rotating sleeve 10. The inner surface of the rotating sleeve 10 is defined in the through hole 101 of the rotating sleeve 10. The rotating knob 11 is mounted on and around the outer end of the rotating sleeve 10 and has an outer end surface 110. The mounting groove 102 is formed around the inner surface of the rotating sleeve 10 and is disposed at the outer end of the rotating sleeve 10. Preferably, the mounting groove 102 is disposed at a middle of the rotating knob 11. The external thread of the rotating sleeve 10 is formed around the outer surface of the rotating sleeve 10.

The mandrel 20 is circular in cross-section and has an outer end, an outer surface, a mandrel knob 21, a positioning groove 22, a groove bottom, a mandrel diameter and a groove diameter. The mandrel knob 21 is formed on the outer end of the mandrel 20 and has a mandrel knob diameter and an inner end surface 210. The mandrel knob diameter is longer than a diameter of the through hole 101 of the rotating sleeve 10. The inner end surface 210 of the mandrel knob 21 corresponds to and abuts the outer end surface 110 of the rotating knob 11 of the rotating sleeve 10. The positioning groove 22 is formed around the outer surface of the mandrel 20, is disposed adjacent to the mandrel knob 21 and corresponds to the mounting groove 102 of the rotating sleeve 10. The groove bottom is defined in the positioning groove 22. The mandrel diameter is defined between two points that are on the outer surface of the mandrel 20, and is shorter than a diameter of the through hole 101 of the rotating sleeve 10. Thus, the mandrel 20 is slidably mounted through the through hole 101 of the rotating sleeve 10, and the inner end surface 210 of the mandrel knob 21 abuts the outer end surface 110 of the rotating knob 11 of the rotating sleeve 10. The groove diameter is defined between two points that are on the groove bottom of the mandrel 20.

A first distance defined between the mounting groove 102 of the rotating sleeve 10 and the outer end surface 110 of the rotating knob 11 is equal to a second distance defined between the positioning groove 22 of the mandrel 20 and the inner end surface 210 of the mandrel knob 21 of the mandrel 20.

The positioning ring 30 is resilient, may be made of rubber, plastic, metal or the like, is mounted in and around the mounting groove 102 of the rotating sleeve 10 and has an outer surface 301, an inner surface 302, an inner diameter and an outer diameter. The outer surface 301 of the positioning ring 30 is disposed in the mounting groove 102 of the rotating sleeve 10. The inner surface 302 of the positioning ring 30 is disposed in the positioning groove 22 of the mandrel 20. The inner diameter is defined between two points that are on the inner surface 302 of the positioning ring 30, is shorter than the mandrel diameter of the mandrel 20 and is longer than the groove diameter of the mandrel 20. The outer diameter is defined between two points that are on the outer surface 301 of the positioning ring 30, and is longer than the mandrel diameter of the mandrel 20.

With reference to FIG. 3, the positioning assembly as described is used in an adjustable type hand rivet nut tool with quick-change mandrel as disclosed in U.S. Pat. No. 5,729,880, which is mentioned in Description of the Prior Art(s). The hand rivet nut tool has a tool body 40 and a holding sleeve 41. The holding sleeve 41 is tubular, is mounted in a top portion 401 of the tool body 40, is able to slide axially and has an internal thread formed around an inner surface of the holding sleeve 41. The rotating sleeve 10 is axially mounted through the holding sleeve 41. The external thread of the rotating sleeve 10 engages the internal thread of the holding sleeve 41. The positioning ring 30 is mounted in the mounting groove 102 of the rotating sleeve 10.

Before operating the hand rivet nut tool, the mandrel 20 is mounted in the through hole 101 of the rotating sleeve 10, and the inner surface 302 of the positioning ring 30 is resiliently mounted around the outer surface of the mandrel 20. Frictional force formed between the positioning ring 30 and the mandrel 20 provides resistance to movement of the mandrel 20. When the inner end surface 210 of the mandrel knob 21 abuts the outer end surface 110 of the rotating knob 11, the inner surface 302 of the positioning ring 30 is disposed in the positioning groove 22 of the mandrel 20.

Figure 4:
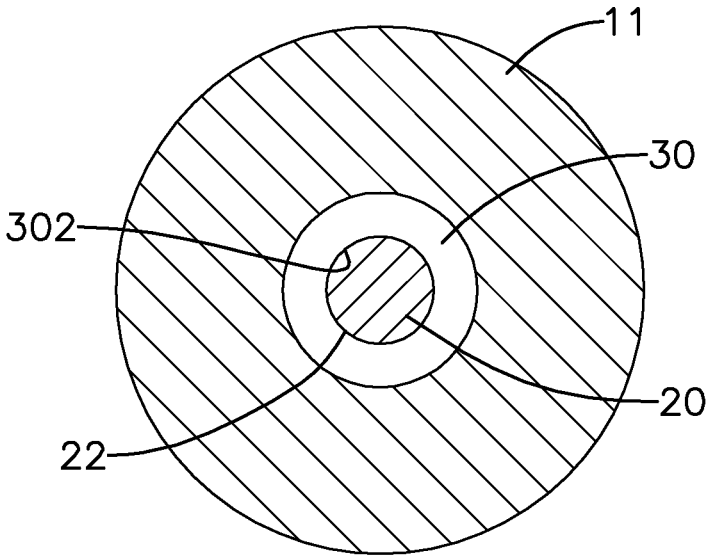
FIG. 4 is a cross-sectional end view of the positioning assembly of the hand rivet nut tool in FIG. 1.
Figure 5:
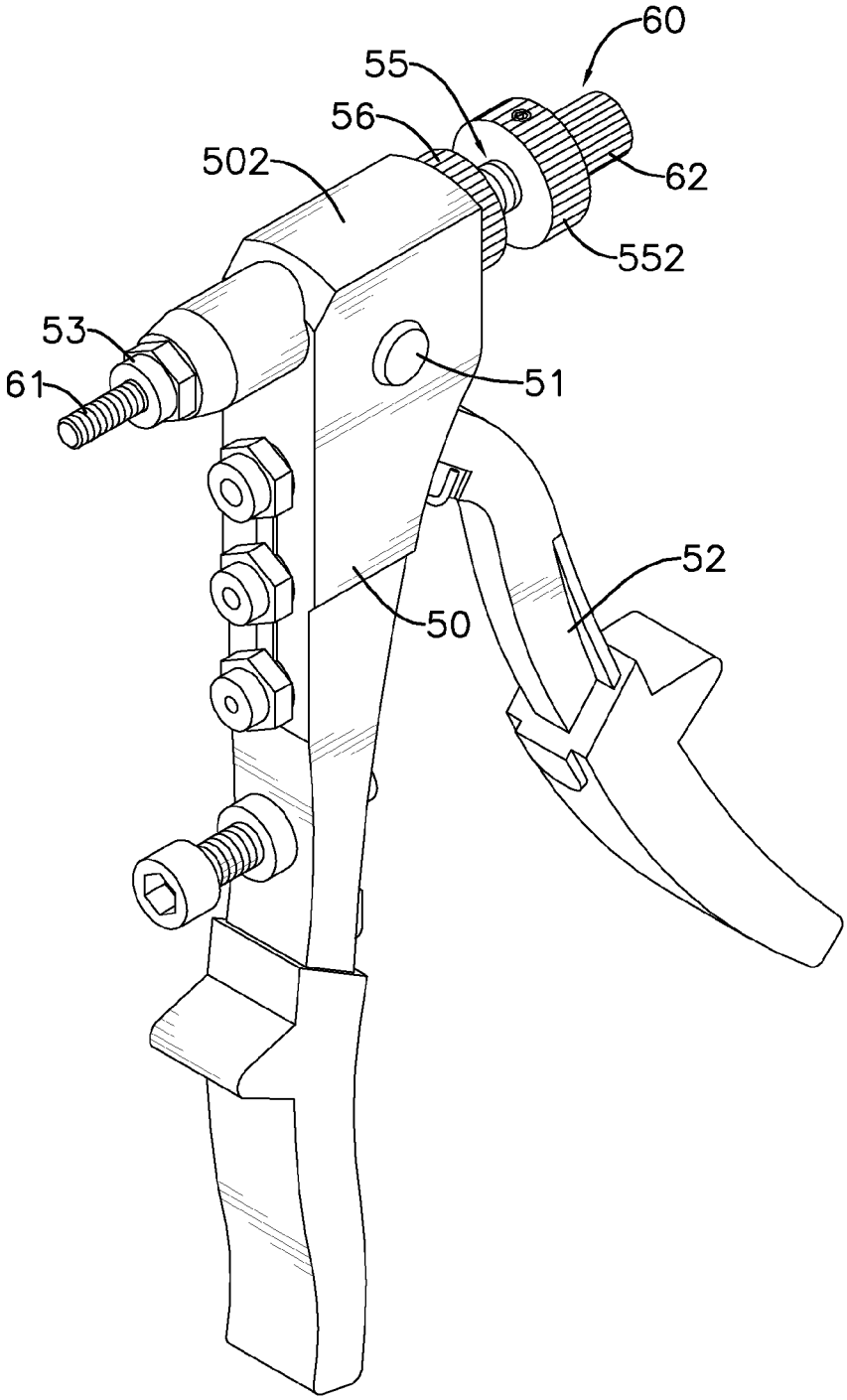
FIG. 5 PRIOR ART
FIG. 5 is a perspective view of a conventional hand rivet nut tool in accordance with the prior art.
Figure 6:
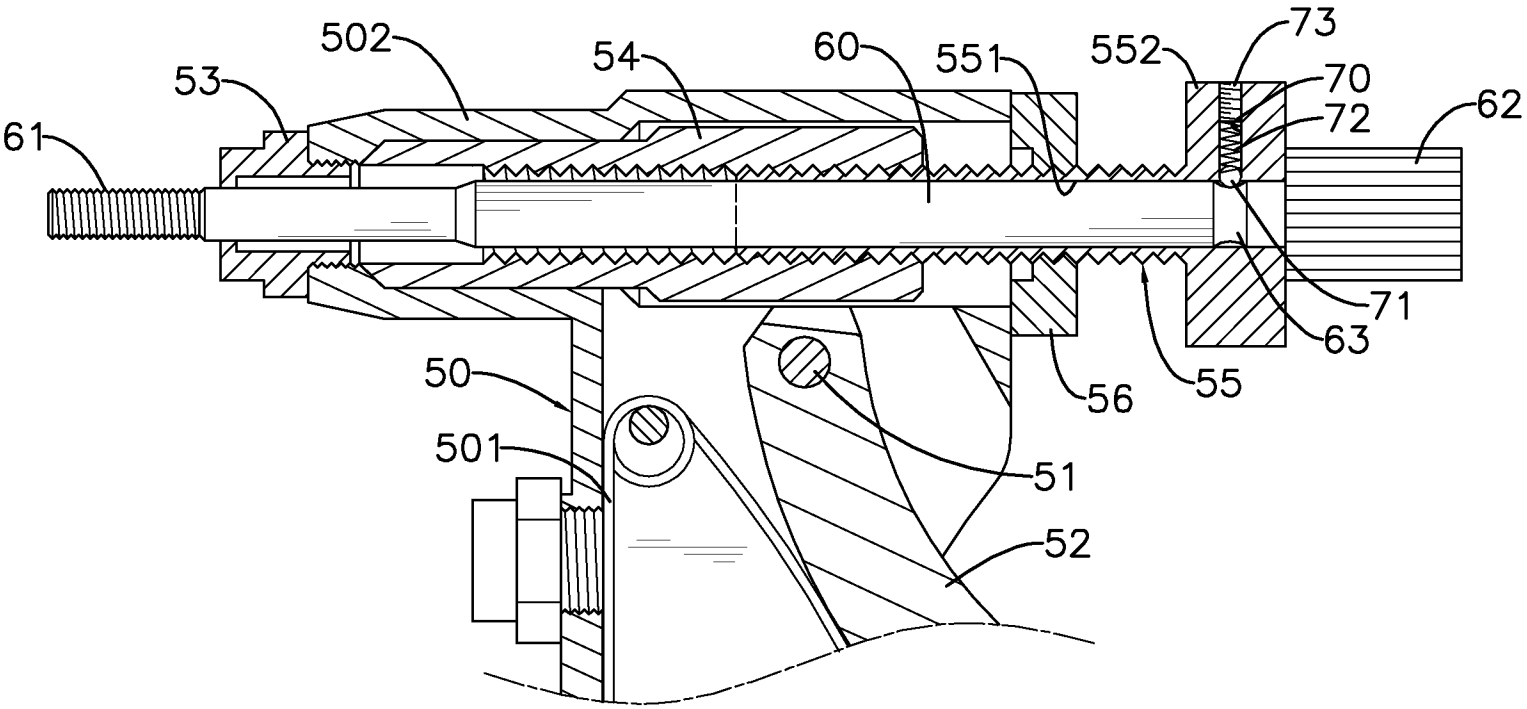
FIG. 6 PRIOR ART
FIG. 6 is an enlarged operational side view in partial section of the conventional hand rivet nut tool in FIG. 5.
Figure 7:
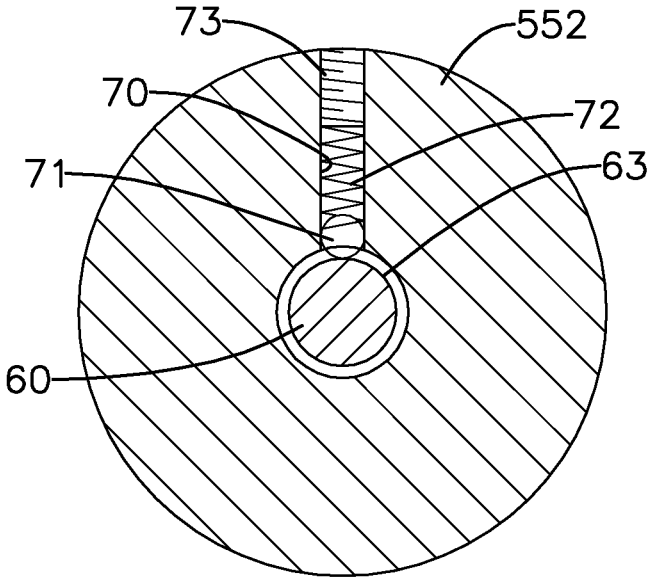
FIG.7 PRIOR ART
FIG. 7 is a cross-sectional end view of a positioning assembly of the conventional hand rivet nut tool in FIG. 5.

With further reference to FIG. 4, the positioning ring 30 is mounted in the positioning groove 22 and engages the mandrel 20, so the mandrel 20 is held in a specific position in the rotating sleeve 10. Since the positioning ring 30 and the groove bottom of the mandrel 20 are having line-contact, the mandrel 20 is stably held by the positioning ring 30. Thus, the mandrel 20 is still able to rotate clockwise or counter-clockwise relative to the rotating sleeve 10 to allow an external thread of the mandrel 20 to engage or disengage from a rivet nut. Then, the hand rivet nut tool stably rivets the rivet nut on a work piece. Therefore, the hand rivet nut tool with the positioning assembly has simplified and optimized positioning effect, and reduced assembling time and cost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A positioning assembly of a hand rivet nut tool comprising:

a rotating sleeve having a through hole axially formed through the rotating sleeve;

an inner surface defined in the through hole of the rotating sleeve;

a rotating knob mounted on and around an outer end of the rotating sleeve; and a mounting groove formed around the inner surface of the rotating sleeve and disposed at the outer end of the rotating sleeve;

a mandrel slidably mounted through the through hole of the rotating sleeve and having a mandrel knob formed on an outer end of the mandrel;

a positioning groove formed around an outer surface of the mandrel, disposed adjacent to the mandrel knob and corresponding to the mounting groove of the rotating sleeve;

a groove bottom defined in the positioning groove;

a mandrel diameter defined between two points that are on the outer surface of the mandrel; and a groove diameter defined between two points that are on the groove bottom of the mandrel; and a positioning ring being resilient, mounted in and around the mounting groove of the rotating sleeve and having an outer surface disposed in the mounting groove of the rotating sleeve;

an inner surface disposed in the positioning groove of the mandrel;

an inner diameter defined between two points that are on the inner surface of the positioning ring, the inner diameter of the positioning ring being shorter than the mandrel diameter of the mandrel and being longer than the groove diameter of the mandrel; and an outer diameter defined between two points that are on the outer surface of the positioning ring, the outer diameter of the positioning ring being longer than the mandrel diameter of the mandrel.

2. The positioning assembly as claimed in claim 1, wherein the rotating knob of the rotating sleeve has an outer end surface;

the mandrel knob of the mandrel has an inner end surface corresponding to and abutting the outer end surface of the rotating knob of the rotating sleeve; and a first distance defined between the mounting groove of the rotating sleeve and the outer end surface of the rotating knob is equal to a second distance defined between the positioning groove of the mandrel and the inner end surface of the mandrel knob of the mandrel.

* * * * *